United States Patent [19]

Stegeman

[11] Patent Number: 4,699,094

[45] Date of Patent: Oct. 13, 1987

[54] ROCKER ARM AND HYDRAULIC LASH ADJUSTER WITH LOAD/MOTION CONTROL BUTTON

[75] Inventor: George T. Stegeman, Union Lake, Mich.

[73] Assignee: General Motors Corporation, Detroit, Mich.

[21] Appl. No.: 867,145

[22] Filed: May 27, 1986

[51] Int. Cl.[4] ..... F01L 1/18

[52] U.S. Cl. ..... 123/90.46; 123/90.49

[58] Field of Search ..... 123/90.27, 90.45, 90.46, 123/90.49, 90.55, 90.52, 90.44

[56] References Cited

U.S. PATENT DOCUMENTS

| | | | |
|---|---|---|---|
| 1,573,962 | 2/1926 | Charnock . | |
| 1,613,012 | 1/1927 | Baker . | |
| 4,570,582 | 2/1986 | Speil | 123/90.46 |

FOREIGN PATENT DOCUMENTS

| | | | |
|---|---|---|---|
| 2652154 | 5/1978 | Fed. Rep. of Germany | 123/90.46 |
| 3118466 | 11/1982 | Fed. Rep. of Germany | 123/90.39 |
| 3208152 | 9/1983 | Fed. Rep. of Germany | 123/90.39 |
| 606405 | 6/1926 | France | 123/90.45 |
| 0775358 | 11/1980 | U.S.S.R. | 123/90.16 |

*Primary Examiner*—Charles J. Myhre
*Assistant Examiner*—David A. Okonsky
*Attorney, Agent, or Firm*—Arthur N. Krein

[57] ABSTRACT

A rocker arm has the valve actuator arm portion thereof provided with a bore and a slot or aperture so as to receive in operative unit assembly therewith a hydraulic lash adjuster that includes a closed end follower having an actuator depending from its closed end which is in the form of a semi-sphere or semi-spheroid which operatively engages into a socket on one side of a load/motion control button, the opposite side of the load/motion control button having a flat surface for abutment against the stem of a valve loosely extending through the slot or aperture so as to be engaged by the load/motion control button.

3 Claims, 7 Drawing Figures

ROCKER ARM AND HYDRAULIC LASH ADJUSTER WITH LOAD/MOTION CONTROL BUTTON

This invention relates to rocker arms with a hydraulic lash adjuster mounted therein and, in particular, to an integral rocker arm and hydraulic lash adjuster with load/motion control button assembly.

DESCRIPTION OF THE PRIOR ART

The desirability of reducing the frictional loss at the interface between a rocker arm and the stem end of an associate valve during the operation of an internal combustion engine while at the same time taking out the lash in such a valve train has long been recognized. One proposed solution to this problem as disclosed, for example, in U.S. Pat. No. 4,570,582 issued Feb. 18, 1986 to Walter Speil or in German Offenlegungschrift No. DE 3118466 A 1 assigned to the same assignee of the above-identified U.S. Pat. No. 4,570,582, is by the use of a hydraulic lash adjuster operatively positioned in the valve actuator arm portion of a rocker arm, with the follower body of the lash adjuster having a semi-spherical closed end that is operatively associated with a separate semi-spherical socket provided in one side of a disc shaped button element, the opposite surface of this button element being flat so as to engage the upper flat free stem end of a valve. However, even in such valve train arrangements, considerable scrubbing action will still occur between the respective elements.

SUMMARY OF THE INVENTION

The present invention relates to a rocker arm assembly with a hydraulic lash adjuster together with a load/motion button in unit assembly within the slotted valve actuator arm portion thereof, the hydraulic lash adjuster including a closed end follower body with the closed end thereof having a semi-spherical or spherical actuator of predetermined radius or radii, whereby it will be in substantial rolling contact with a socket provided on one side of the load/motion control button, the opposite side of the load/motion control button having a flat surface for engaging the stem of a valve which is located so as to loosely extend through the slot in the valve actuator arm portion of the rocker arm. Preferably, at least the socket surface of the load/motion control button is coated with a lubricant, such as tin.

Accordingly, a primary object of this invention is to provide an improved rocker arm with integral hydraulic lash adjuster and load/motion control button, wherein the follower body of the lash adjuster is provided with a semi-spherical or semi-spheroidal actuator that is in substantial rolling contact within a socket provided in one side of the load/motion control button which is operatively positioned in the rocker arm so that its opposed flat side is engaged by the stem of a valve to be actuated.

For a better understanding of the invention as well as other objects and further features thereof, reference is had to the following detailed description of the invention to be read in connection with the accompanying drawings.

DESCRIPTION OF THE EMBODIMENTS

Figure 1:
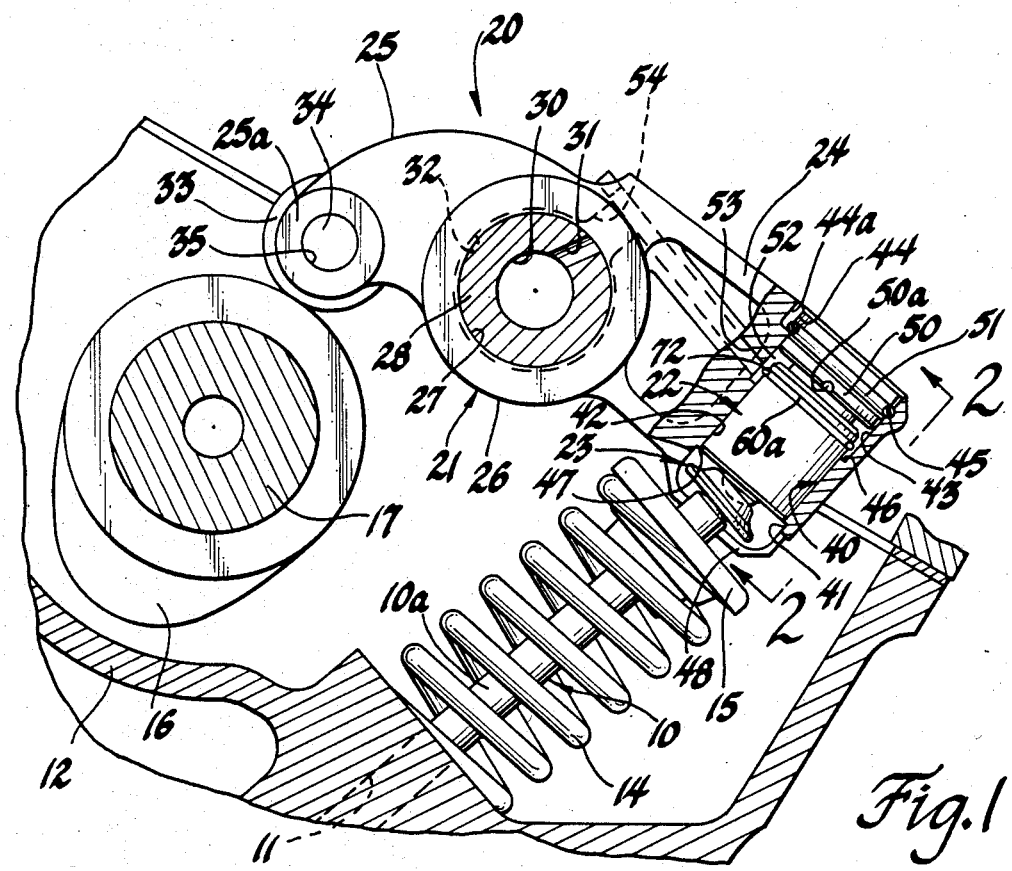
FIG. 1 is a cross-sectional view of a portion of an internal combustion engine having an integral rocker arm and hydraulic lash adjuster with load/motion control button assembly in accordance with a first embodiment of the invention incorporated therein.

Referring first to FIG. 1, there is illustrated a portion of an engine which includes the stem 10*a* of a poppet valve 10 which is supported in the guide bore 11 in the cylinder head 12 for movement to open or close a port, not shown, which can be either an inlet port or an exhaust port. The stem 10*a* of the poppet valve 10 is normally biased to a valve closed position, the position shown, by a valve return spring 14. One end of the spring 14 is in abutment against an upper surface of the cylinder head 12 while the opposite end of the spring 14 engages a suitable retainer 15 fixed in a convention manner to the upper free end of the stem 10*a* of the poppet valve 10 but axially spaced from the free end thereof for a purpose to be described.

The stem 10*a* of the poppet valve 10 is suitably operated as by a cam 16 on a camshaft 17 via a rocker arm and hydraulic lash adjuster with load/motion control button, generally designated 20, constructed in accordance with a first embodiment of the invention, which includes a rocker arm 21 having a hydraulic lash adjuster 22 and a load/motion control insert or button, hereinafter referred to as button 23, supported therein.

The rocker arm 21 is provided with a valve actuator arm 24 and cam actuator arm 25 overlying the stem 10*a* of the poppet valve 10 and cam 16, respectively, and with an intermediate support portion 26 having a transverse bore 27 extending therethrough, the latter being used to support this assembly on a fixed hollow rocker shaft 28.

As is conventional, the rocker shaft 28 is supported above the cylinder head 12 as by suitably spaced apart brackets, not shown. Also as well known, the rocker shaft 28 is provided with an axial extending bore 30 which is in continuous communication with the pressurized lubricant oil supply of the engine through suitable interconnecting passage means, not shown, and the rocker shaft 28 is provided with at least one riser passage 31 for each rocker arm assembly 20 that communicates with an annular groove 32 provided in either the outer peripheral surface of the rocker shaft 28 or, as shown, in the inner peripheral surface in the bore 27 of the rocker arm 21 to be described hereinafter.

In the construction illustrated, the cam actuated arm 25 is bifurcated at its free end to define spaced apart roller support arms 25*a* (FIG. 2) so as to loosely receive a cam follower roller 33 suitably rotatably supported on a shaft 34 fixed in and extending through suitable apertures 35 provided for this purpose in the support arms 25*a*.

Figure 2:
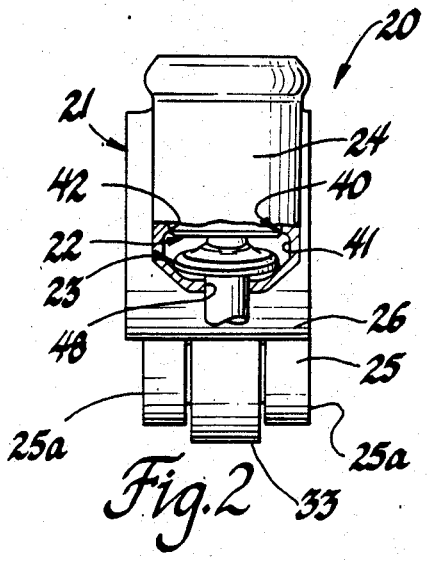
FIG. 2 is an end view of the rocker arm assembly and valve of FIG. 1 taken along line 2—2 of FIG. 1, with part of the rocker arm broken away to show internal elements supported within the rocker arm.

In the embodiment shown, the valve actuator arm 24 is provided with a stepped bore 40 in the outer, free end cylindrical end portion of this arm so as to define in succession, starting from the lower end, a cylindrical lower wall 41, a follower body guide wall 42, an upper intermediate wall 43 and an upper wall 44 having a retainer groove 45 therein so that, in effect, this groove 45 interconnects with the wall 43, this wall 43 being of a smaller internal diameter than that of upper wall 44. The follower body guide wall 42 is of a internal diameter less than that of adjacent walls 43 and 41 and is connected to wall 43 by a flat shoulder 46 and is connected to wall 41 by a shoulder 47. In addition and as best seen in FIGS. 1 and 2, the lower free end portion of the valve actuator arm 24 is provided, for example with a longitudinal slot 48 formed at right angles to the axis of the rocker arm 21, which slot breaks through the lower wall 41 and is formed of a suitable width so as to loosely receive the upper free end of the stem 10*a* of the poppet valve 10.

As shown in FIG. 1, one end or upper end of the bore 40 is closed by means of a disc retainer 50 that is positioned in the upper intermediate wall 43 and retained against axial movement in one direction, upward with reference to this Figure, by means of a split ring retainer 51 operatively positioned in the retainer groove 45. Also as seen in this Figure, the upper wall is also provided with a vertical groove 44*a* of a suitable width to receive a tool, such as a screwdriver, not shown, to permit removal of the split ring retainer 51 if desired.

The lower surface of the disc retainer 50, which is provided with at least one radial cross groove 50*a* therein, forms with the upper intermediate wall 43, a fluid reservoir 52 which is in flow communication via a bored passage 53 which extends from the wall 43 through the valve actuator arm 24 and into the support portion 26 so as to intersect a riser bore 54 in the support portion 26 that opens at its lower end through the bore 27 wall whereby it is always in fluid communication with the groove 32 and with the bore 30 in the rocker shaft 28.

Figure 3:
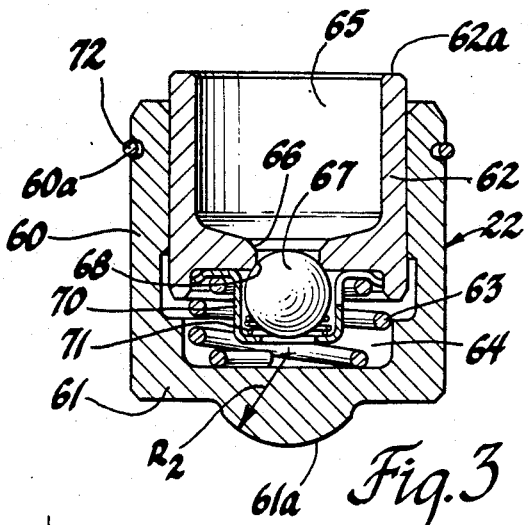
FIG. 3 is a cross-sectional view of the hydraulic lash adjuster, per se, of FIG. 1.

The hydraulic lash adjuster 22, as best seen in FIG. 3, except for the specific configuration of the closed end of the follower body thereof, is of conventional construction and includes a cup-shaped, follower body 60, having a closed end 61, that is slidably received in the follower guide wall 42. A plunger or piston 62 has a close sliding fit for reciprocation within the follower body 60 and is normally biased upwardly therein by a plunger spring 63 so that its upper end 62*a* abuts against the lower surface of the disc retainer 50, as seen in FIG. 1. The plunger spring 63 also acts against the closed end 61 of the follower body 60 so as to maintain the actuator 61*a* to be described, on its closed end 61 in operative engagement with the control button 23, which in turn is thus maintained in abutment against the upper free end surface of the stem 10*a* of the poppet valve 10, as shown in FIGS. 1 and 2.

The lower end of the plunger 62 forms with the closed end of the follower body 60 a pressure chamber 64 while the upper open end of the plunger 62 defines a supply chamber 65 that is in continuous flow communication with the fluid reservoir 52 in the embodiment illustrated. The supply chamber 65 is in flow communication with the pressure chamber 64 via an axial port 66, flow through which is controlled by a one-way valve in the form of a ball 67 which closes against a seat 68 of the plunger that encircles port 66.

A suitable valve cage 70 and valve return spring 71 limits open travel of the valve ball 67 to the amount necessary to accommodate replenishment of the pressure chamber 64 with oil which normally escapes therefrom between the sliding surfaces of the plunger 62 and follower body 60 as "leak-down" during cam induced opening movements of the stem 10*a* of the poppet valve 10. As shown, the valve cage 70 is held in position against the plunger 62 by the plunger spring 63, or alternatively, the valve cage 70 could be held as by a press fit to the plunger 62.

In addition, the hydraulic lash adjuster 22 is also axially retained for limited movement in one direction within the rocker arm 21 by means of a retainer ring 72 operatively positioned in an annular groove 60*a* provided for this purpose in the outer peripheral surface of the follower body 60, whereby the retainer ring 72 can come into abutment against the shoulder 46 to thereby limit downward travel, with reference to FIG. 1, of the follower body 60 a predetermined axial extent such that the button 23 is loosely trapped within the rocker arm 21 in a manner whereby this button 23 cannot tilt enough so that it could possibly fall out through the slot or hole 48, as during shipment of this rocker arm assembly to an engine plant.

Figure 4:
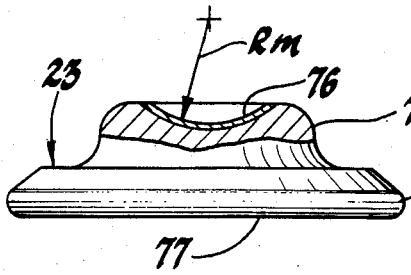
FIG. 4 is a side view of the load/motion control button, per se, with a part broken away to show the semi-spherical socket in accordance with the first embodiment on one side thereof.

In the first embodiment and as shown in FIGS. 1 and 3, the actuator 61*a* is of semi-spherical configuration with a predetermined radius $R_2$, determined in a manner to be described in detail hereinafter. Accordingly, with an actuator 61*a* of semi-spherical configuration, the button 23, as best seen in FIG. 4 is in the form of a circular disc 74 having a central raised boss portion 75 with an actuator receiving socket 76 therein that, for example, is also of semi-spherical configuration of a suitable radius $R_m$ that is a predetermined amount greater than the radius $R_2$ of the actuator 61*a*. As shown, the circular disc 74 is provided with a flat bottom surface 77 for abutment against the upper flat free end surface of the stem 10*a* of the poppet valve 10. Also as best seen in FIGS. 1 and 2, the outside diameter and thickness of the button 23 is preselected so that this button 23 can articulate around the actuator 61*a* within the cavity defined by the lower wall 41 in the valve actuator arm.

Preferably, at least the surface defining the socket 76 is provided with a suitable lubricant, such as a coating of tin, whereby to provide for lubrication between it and the actuator 61*a* during initial engine start up, after which these elements will be lubricated by oil leakage from between the guide wall 42 and the outer peripheral surface of the follower body 60 or, by splash lubrication in a manner well known in the art.

Figure 5:
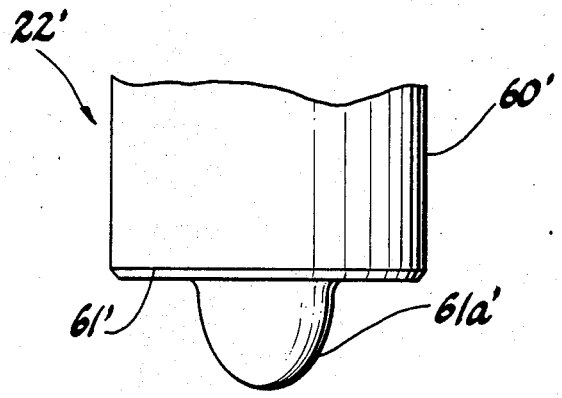
FIG. 5 is an enlarged view of the actuator of a hydraulic lash adjuster having an actuator in the form of a spheroid in accordance with a second embodiment of the invention.
Figure 6:
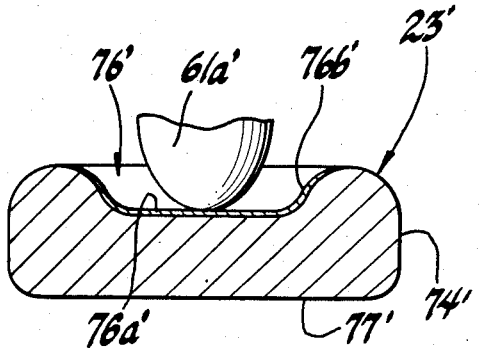
FIG. 6 is a section view of a load/motion control button, per se, for use with the alternate embodiment actuator of FIG. 5; and, FIG. 7 is a schematic graphic illustration of the valve train geometric relationship of the rocker arm pivotal movement from a valve closed position to a valve open position that is used to calculate the contour shape of an actuator on the closed end of the hydraulic lash adjuster in accordance with the invention.

An alternate embodiment of a lash adjuster follower body with an actuator and an associate load/motion control button in accordance with the invention are shown in FIGS. 5 and 6, respectively wherein similar parts are designated by similar numerals but with the addition of a prime (′) where appropriate.

Referring first to FIG. 5, the follower body 60' of the lash adjuster 22' has its closed end 61' provided with a depending actuator 61a' that is of a semi-spheroidal configuration at its lower end, that is, this lower end portion is formed with predetermined different radii from the central vertical axis of the follower body 60' in a manner and for a purpose to be described in detail hereinafter.

Accordingly, in this alternate embodiment and as shown in FIG. 6, the button 23' is in the form of a circular disc 74' having on one side thereof a socket 76' defined by a circular lower flat surface 76a' encircled by a cylindrical arcuate raised wall 76b', the opposite side having an opposed lower flat surface 77'. As with the previously described load/motion control button 23, at least the surfaces 76a' and raised wall 76b' defining the socket 76' of the button 23' are also preferably coated with tin.

As well known in the art, a rocker arm of the type illustrated is in the form of a pivotal lever, with the effective working length or operating radius of the valve actuator arm, such as arm 24, from the pivot axis of the rocker arm which corresponds to the longitudinal axis of the rocker shaft 28, in the construction illustrated, is selected relative to the effective working length or radius of the cam actuated arm, such as arm 25, and of course the rise of the associate cam, such as cam 16, which then, of course, determines the angle through which the valve actuator arm should rotate in order to provide for the desired lift of an associate valve, such as poppet valve 10.

Since in the construction shown, a hydraulic lash adjuster, such as lash adjuster 22, is incorporated into the valve actuator arm, the effective working length or operating radius of the valve actuator arm, as conventional in the art, will be preferably predetermined from the pivotal axis of the rocker arm to a point on the operating axis of the follower body of the hydraulic lash adjuster when the follower body is in effect in a mean operative position, since it is also well known in the art that the follower body, such as follower body 60 is designed to move up or down from this mean position a predetermined limited axial extent in a particular engine valve train application to compensate for any increase or decrease in valve train length, that is, in order for it to operate so as to take-up any lash in the valve train.

Of course, it is also well known that during pivotal movement of the rocker arm from a valve closed position to a valve open position, the effective operative contact point between an associate element of the valve actuator arm and the upper stem surface of an associate valve, will normally, in effect, move laterally across the stem surface in sliding or so-called scrubbing engagement therewith a predetermined distance as a function of the operating radius of the valve actuator arm and the degrees of its pivotal movement, with this scrubbing movement producing considerable friction in the valve train system.

Now in accordance with a feature of the invention, in order to eliminate or substantially reduce such scrubbing movement and thereby reduce frictional losses, the actuator 61a on the closed end 61 of the follower body 60, with reference to the first embodiment as best seen in FIGS. 1 and 3 is of a semi-spherical configuration with a predetermined radius, determined in a manner to be described, which cooperates with a button 23 having, for example, a complementary shaped semi-spherical socket 76 on an associate one side thereof such that the actuator 61a is in substantial sliding contact with the socket surface or, alternatively, the actuator 61a', with reference to the alternate embodiment shown in FIG. 5, is of a semi-spheroid configuration formed with predetermined radii, determined in a manner to be described, which cooperates with a button 23' having a socket 76a' surface such that the actuator 61a' is in substantially rolling contact therewith.

Figure 7:
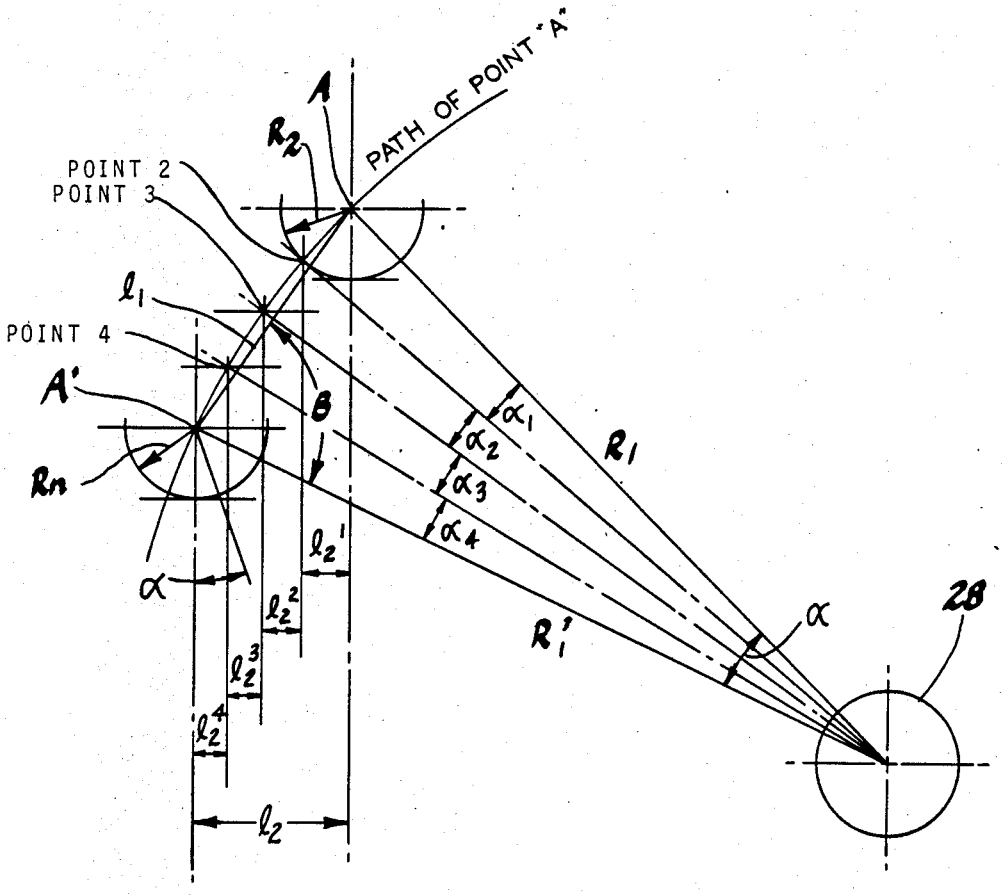

Thus valve tip scrub (frictional loss) from rocker arm contact is prevented or controlled in accordance with the subject invention by providing for a predetermined geometric relationship of the actuator 61a, 61a' element and the socket in the load/motion control button 23, 23', respectively, interface with respect to its relationship to the valve train geometric relationship as schematically illustrated in FIG. 7.

The radius $R_2$ of the semi-spherical actuator 61a or the radii $R_n$ of the semi-spheroidal actuator 61a' are selected in specific relationship to the preselected, effective working radius $R_1$ of the valve actuator arm 24. The included angle between the centerline axis or lines parallel thereto of the poppet valve 10, that is, the reciprocating axis of poppet valve 10 and $R_1$ must be less than 90° at the valve closed position, and must not exceed 90° at the valve open position. Thus the radius $R_2$ or the radii $R_n$ are selected to provide relative outboard motion between the actuator 61a, 61a' and the button 23, 23', respectively, equal to the outboard motion developed by $R_1$ as it rotates through a predetermined angle $\alpha$ to effect the desired lifting motion of the poppet valve 10 without causing any significant sliding motion of the button 23, 23' relative to the upper free end surface of the valve stem 10a.

Referring now to FIG. 7, the radius $R_2$ of the semi-spherical actuator 61a or the radii $R_n$ of the semi-spheroidal 61a' can be calculated from the valve train geometric relationship shown, as follows, wherein $R_n$ = variable hydraulic element contact surface radius of 61a, 61a';

$R_2$ = specific hydraulic element contact sphere radius of 61a, 61a' at some moment;

$R_1$ = rocker arm lever arm - pivot center to center of 61a, 61a';

$R_1'$ = position of $R_1$ after some rotation of rocker arm;

Point "A" = center of contact sphere radius at valve end of $R_1$, that is, the center of actuator 61a or 61a';

Point "A'" = point "A" moved to some new position with $R_1'$;

$\alpha$ = angle of rotation $R_1$ to $R_1'$;

$l_1$ = chord of a circle formed by $R_1$ and limited by $\alpha$ or fractions thereof as described hereinafter;

Point 1 = effective contact point between 61a, 61a' and button 23, 23', respectively, at valve closed position;

Point 2 = contact point between 61a, 61a' and button 23, 23', respectively, at valve open position after rotation $\alpha$;

$l_2$ = distance between two lines; centerline passing thru point 5 and a line parallel passing thru point 1;

$l_3$ = length along the outer peripheral contact surface of the actuator 61a, 61a' element between points 1 and 5.

Now if $\alpha$ is equal to the total degrees of valve actuator arm rotation then:

$$\beta = \frac{180 - \alpha}{2}$$

$$\text{Chord} \quad l_1 = 2R, \sin\frac{\alpha}{2} \quad \text{(Definition of the chord)}$$

-continued $l_2 = l_1, \cos\beta$ (lateral movement between contact points 1 and 5.

Now if $l_2$ is set to equal $l_3$ then:

$$l_3 = 2\pi R_n \frac{\alpha}{360} \text{ or}$$

$$R_n = \frac{l_3}{2\pi \frac{\alpha}{360}}$$

Since in the above solution $\alpha$ was picked to represent the total degrees of valve actuator arm rotation $R_n$, will then equal $R_2$, thus defining the radius $R_2$ of the semi-spherical actuator 61*a*.

However, it should now be apparent to those skilled in the art that if an $\alpha'$ which could be equal to each degree of the total angle of rotation $\alpha$ or $\alpha_1$, $\alpha_2$, $\alpha_3$ and $\alpha_4$ (each equals $\frac{1}{4}\alpha$), as shown in FIG. 7, were substituted for $\alpha$ in the above equations to obtain contact points 1–2; 2–3; 3–4; and 4–5 so as to obtain the values for $l_2^1$, $l_2^2$, $l_2^3$, and $l_2^4$, respectively, so as to obtain different values for $R_n$, at each of these predetermined fraction degrees of total rocker arm rotation, then a series of points could be plotted, which when properly connected together would define a curve having different radii whioh can then be used to define the outer peripheral surface contour of the semi-spheroid actuator 61*a'* as shown in FIG. 5. It will be appreciated by those skilled in the art that this spheroidal configuration requires surface contour development, in effect, in a manner similar to that of a camshaft lobe profile where the various radial center locations are distinct and not common. The radii will thus vary accordingly along with subtle modifications, as desired, to obtain a predetermined effect valve lift profile. As should now be apparent to those skilled in the art, the final goal to be desired is to achieve motion between the associate elements which is within a predetermined design intent, i.e., to reduce or obtain zero frictional losses or, alternatively, to increase such loss to cause frictional damping, if desired.

It should now also be apparent to those skilled in the art that the alternate embodiment shown in FIGS. 5 and 6 would be considered to be the preferred embodiment since it can be configured so as to provide for substantial rolling contact between the actuator 61*a'* and the socket surface of the associate button 23', whereas the embodiment shown in FIGS. 1–4 may be considered to be the preferred embodiment from a manufacturing viewpoint since it obviously is easier to produce a quality semi-spherical element on a mass production basis than to produce a semi-spheroid.

Although by the use of the above described set of equations, specific values can be obtained for the radius $R_2$ of the actuator 61*a* or the radii $R_n$ of the actuator 61*a'*, it will be apparent that these values can be modified, as desired, within specific limits, as for example due to the axial extend of travel of the follower body 60 of the lash adjuster 22, with reference to the first embodiment or due to the fact that as shown in FIG. 7, the preselected radius $R_1$ is actually greater than the actual working radius from the pivot axis, corresponding to the axis of the rocker shaft 28, to the contact points 1–5, for a given engine application while still obtaining the advantages of the subject invention.

Accordingly, while the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. An integral rocker arm and hydraulic lash adjuster with load/motion control button assembly including a rocker arm having a cam actuated arm portion, an intermediate support portion with a cylindrical bore extending transversely therethrough whereby the rocker arm is adapted to be pivotably supported about a pivot axis and supplied with pressurized oil and an opposed valve actuator arm to control the opening and closing movement of a valve via a valve stem thereof, said valve actuator arm having a stepped bore therethrough and a slot means extending through said stepped bore at a right angle to said pivot axis and having a width so as to slidably receive the valve stem, said stepped bore defining, in succession starting from a lower end, a cylindrical enlarged lower wall defining a cavity, an adjuster guide wall, anenlarged intermediate wall and a further enlarged upper wall with a retainer groove therein, an abutment shoulder connecting said adjuster guide wall and said intermediate wall and a second abutment shoulder connecting said intermediate wall and said retainer groove in said upper wall; a disc retainer positioned in said intermediate wall and defining therewith a reservoir adapted to be supplied with oil under pressure; a split ring retainer operatively positioned in said retainer groove to secure said disc retainer aganist axial movement in one direction; a hydraulic lash adjuster including a cylindrical follower body having a closed end slidably received in said adjuster guide wall and a plunger operatively positioned within said follower body to abut at one end aganist said disc retainer, said closed end of said follower body having an actuator depending coaxial therefrom a predetermined axial extent with said actuator having a semi-roundish shaped outer peripheral surface configuration; and, a load/motion control button loosely positioned and retained within said cavity defined by said lower wall, said load/motion control button having a socket on one side thereof operatively engaging said semi-roundish shaped actuator in substantially rolling contact therewith, the opposite surface of said load/motion control button being flat for abutment against the valve stem, the arrangement being such that an effective working radius $R_1$ of said valve actuator arm and an included angle between the reciprocating axis of said valve and $R_1$ is less than 90° at the valve closed position and must not exceed 90° at the valve open position whereby during pivotal movement of the rocker arm said load/motion control button will exhibit no or reduced scrub across said valve stem.

2. An integral rocker arm and hydraulic lash adjuster with load/motion control button assembly according to claim 1 wherein said actuator is of a semi-spherical configuration of a predetermined radius and wherein said socket in said load/motion control button is of a complementary semi-spherical configuration of a radius greater than said predetermined radius of said semi-spherical actuator.

3. An integral rocker arm and hydraulic lash adjuster with load/motion control button according to claim 1 wherein said actuator is of a semi-spheroidal configuration of predetermined radii and wherein said socket in said load/motion control button has a substantially flat surface upon which said semi-spheroidal actuator can roll upon during pivotal movement of said rocker arm.

* * * * *